US009022142B2

(12) United States Patent
Pirinen et al.

(10) Patent No.: US 9,022,142 B2
(45) Date of Patent: May 5, 2015

(54) METHOD AND APPARATUS FOR OPENING THREADED JOINTS OF DRILLING EQUIPMENT

(75) Inventors: Tuomo Pirinen, Tampere (FI); Vesa Uitto, Tampere (FI); Miika Huikkola, Tampere (FI); Maunu Manttari, Tampere (FI); Sami Hanski, Tampere (FI); Isto Ahonen, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 277 days.

(21) Appl. No.: 13/695,922

(22) PCT Filed: May 3, 2011

(86) PCT No.: PCT/FI2011/050407

§ 371 (c)(1),
(2), (4) Date: Nov. 2, 2012

(87) PCT Pub. No.: WO2011/138511

PCT Pub. Date: Nov. 10, 2011

(65) Prior Publication Data

US 2013/0048378 A1 Feb. 28, 2013

(30) Foreign Application Priority Data

May 4, 2010 (FI) ..... 20105486

(51) Int. Cl.

| | |
|---|---|
| ***E21B 47/00*** | (2012.01) |
| ***E21B 44/00*** | (2006.01) |
| ***E21B 19/16*** | (2006.01) |
| ***E21B 1/00*** | (2006.01) |

(52) U.S. Cl.
CPC ..... *E21B 19/167* (2013.01); *E21B 1/00* (2013.01)

(58) Field of Classification Search
USPC ..... 175/24, 40; 166/377
See application file for complete search history.

(56) References Cited

U.S. PATENT DOCUMENTS

| | | | | |
|---|---|---|---|---|
| 2007/0007040 | A1 | 1/2007 | Bergstrand | |
| 2013/0036812 | A1 * | 2/2013 | Pirinen et al. | 73/152.52 |

FOREIGN PATENT DOCUMENTS

| | | | |
|---|---|---|---|
| JP | 61056966 | A | 3/1986 |
| JP | 62021986 | A | 1/1987 |
| JP | 8270368 | A | 10/1996 |

* cited by examiner

*Primary Examiner* — William P Neuder
(74) *Attorney, Agent, or Firm* — Corinne R. Gorski

(57) ABSTRACT

The invention relates to a method and apparatus for opening threaded joints of drilling equipment (6) by striking the drilling equipment (6) with the percussion device of a rock drilling rig (1) and by measuring vibration originating from the drilling equipment (6) during striking. In addition to vibration, measuring means (9) measure a parameter defining at least one additional condition, on the basis of which the decision to stop striking is made.

32 Claims, 3 Drawing Sheets

METHOD AND APPARATUS FOR OPENING THREADED JOINTS OF DRILLING EQUIPMENT

RELATED APPLICATION DATA

This application is a §371 National Stage Application of PCT International Application No. PCT/FI201/050407 filed May 3, 2011 claiming priority of Finnish Application No. 20105486, filed May 4, 2010.

BACKGROUND OF THE INVENTION

The invention relates to a method for opening threaded joints of drilling equipment by striking the drilling equipment with the percussion device of a rock drilling rig, the method comprising measuring vibration originating from the drill rod during striking and analysing the measured vibration according to a predefined principle for the purpose of determining whether the threaded joints have opened.

The invention further relates to an apparatus for opening threaded joints of drilling equipment by striking the drilling equipment with the percussion device of a rock drilling rig, the apparatus comprising a control device for controlling the rock drilling rig and having a measuring device for measuring vibration originating from the drill rod during striking and analysing means analysing the measured vibration according to a predefined principle for the purpose of determining whether the threaded joints have opened.

When drilling long holes into rock or ground, drill rods are used in which several threaded drill rods are connected together in succession. During drilling, the threads tighten due to both rotating torque and impacts directed to them by the percussion device and stress waves generated as a result of the impacts, and in practice, it is generally not possible to open them with just a rotating motor.

As known, this problem has usually been solved in such a manner that the operator has, after the drilling of the hole has ended, struck the drill rods with the percussion device while they are not under feed force, whereby a suitable number of impacts have loosened the threads. The operator does this by experience and usually stops the striking when hearing a certain type of noise or vibration from the drill rod.

In practice, a problem arises herein from the fact that it is difficult for the operator to detect the loosening of the threads and it does not always succeed the first time. A problem is that unnecessary striking after the threads are already open wears and may even damage the drill rods. Further, the fact that the operator has to do this manually prevents automatization.

Attempts of different type have been made to provide automated drill rod opening and thread openness detection. These are described in publications EP1671011, JP56966/1986, and JP1864566, for example. However, the solutions presented therein are not completely reliable in practice.

One known solution also uses timers to try to control the duration of striking. However, this is not completely reliable, because the time required for striking depends on the drilling parameter values, rock conditions, and even the specific rock drilling rig, for instance. Thus, the striking time varies considerably, and it is difficult to determine a suitable value. Correspondingly, in known automated striking solutions, the result is entirely independent of the operation and accuracy of the equipment, which is not sufficient in practice.

BRIEF DESCRIPTION OF THE INVENTION

It is an object of this invention to provide a method with which striking may be done more reliably than in the known solutions and it is even possible to use entirely automated striking.

The method of the invention is characterised by defining for striking not only a comparison, but also at least one additional condition, on the basis of which the decision to stop striking is made.

The apparatus of the invention is characterised in that it comprises measuring means for measuring a parameter defining at least one additional condition, on the basis of which the decision to stop striking is made.

The idea of the invention is that at least one additional condition is defined, preferably a minimum striking count which the striking must exceed before it may be stopped when the other conditions are satisfied. According to an embodiment of the invention, alternatively or in addition to this, another additional condition is defined, that is, a maximum striking count after which the striking is stopped, if the opening of the threads has not succeeded on the basis of signal measurement and analysis. Further, in the method of the invention, these limit values may be adjusted for each apparatus, for instance, or even depending on the circumstances and equipment so that the striking may be adapted to the circumstances and equipment at the time of use.

The invention provides the advantage that the operation is not merely bound to fixed or adjustable timers or mechanical sensors, but the effect of both the equipment and circumstances may be taken into account. Further, this way the uncertainties of merely detecting the opening are avoided, when a reliable result of the operation is ensured by using the limit values. Another advantage is that, during drilling, it is possible to adjust the minimum or maximum striking counts, or even automate this, or for example implement it in such a manner that the control system suggests a change and the operator either accepts or rejects it.

BRIEF DESCRIPTION OF FIGURES

The invention will be described in greater detail in the attached drawings, in which.

DETAILED DESCRIPTION OF THE INVENTION

Figure 1:
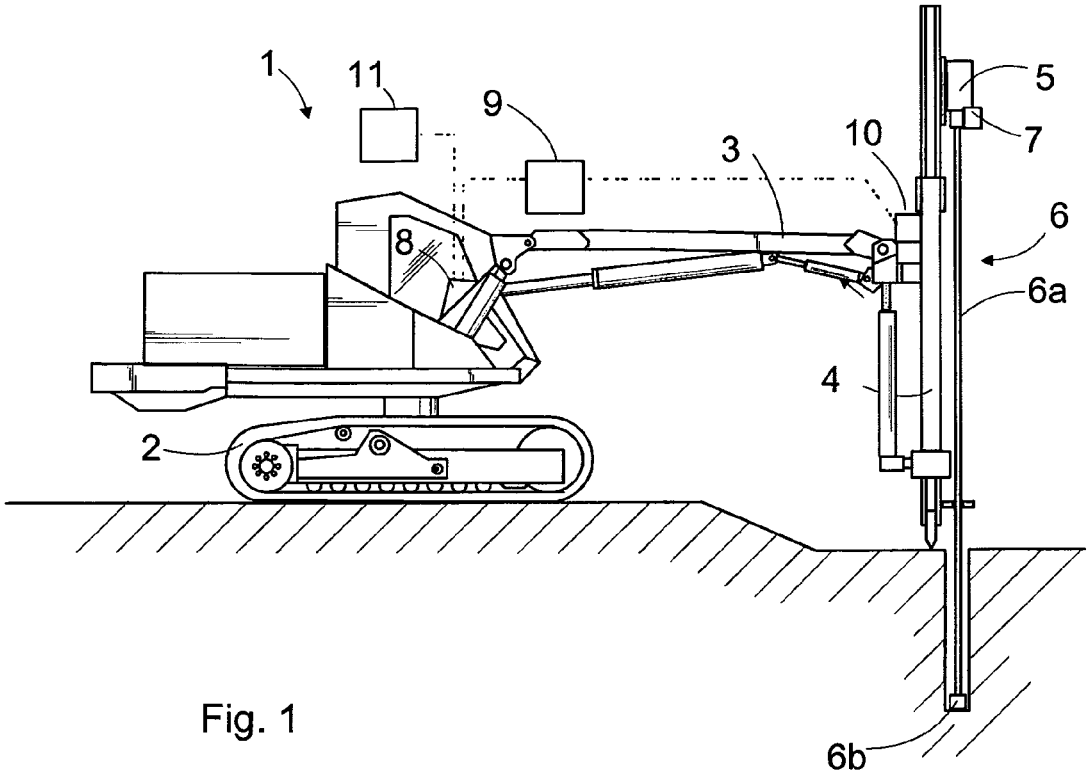
FIG. 1 is a schematic representation of a rock drilling rig.

FIG. 1 is a schematic representation of a rock drilling rig 1 with a carriage 2 having a boom 3 connected thereto. To one end of the boom 3 a feeding beam 4 is connected, along which a rock drilling machine 5 moves during use. Drilling equipment 6 is connected to the rock drill 5, and during drilling the equipment is rotated and struck with a percussion device belonging to the rock drill.

The drilling equipment 6 comprises one or more drill rods 6*a* and a drill bit 6*b* that are connected to each other by threaded joints in a manner known per se. A drill shank used in some rock drilling rigs, which is not shown herein but known per se to a person skilled in the art and usually located inside the rock drilling machine, is also part of the drilling equipment in them.

Rock drilling rigs of this type, and their operation are generally known and it is, therefore, not necessary to describe them in detail.

The rock drilling machine 5 of the rock drilling rig 1 has a percussion device used in drilling and known per se. Its operation and structure are generally known and, therefore, it need not be described in detail. To open the threaded joints of the drilling equipment 6, the drilling equipment is struck with the percussion device of the rock drilling rig and possibly rotated in the opening direction of the threads with a rotating motor 7 known per se and belonging to the rock drilling rig. The forces generated in the drilling equipment then slowly make the threaded joints loosen. In this patent application and claims, striking means that the drilling equipment is struck with the percussion device of the rock drilling rig or with a separate striking device in the longitudinal direction of the drill rods without feeding the drilling machine toward the rock being drilled.

The rock drilling rig 1 also has a control device 8 that controls the functions of the rock drilling rig during drilling and other use. The control device 8 has either a separate or integrated measuring device 9 for measuring the vibration originating from the drill rod during striking and analyzing means 11 for analysing the measured vibration.

The measuring device 9 measures in particular the vibration originating from the drilling equipment during striking by means of a sensor 10 connected to the measuring device. The measuring device 9 may be part of the control device 8 or a separate device, and it may also be implemented by a computer program in the control device 8. The sensor 10 may, in turn, be a microphone that measures audio signals, strain gauge that measures stress waves, or acceleration sensor that measures acceleration, or any other suitable sensor.

The measuring may be directed to the drilling equipment 6, rock drilling rig body or a location connected thereto, a sound propagating in the air, etc.

The analysing means, in turn, analyse the measured vibration in accordance with a predefined principle to determine whether the threaded joints have opened. The control device also contains, either as separate or integrated parts, measuring means, such as measuring devices, for measuring a parameter defining at least one additional condition, on the basis of which the decision to stop striking is made. This is explained later in more detail.

Figure 2:
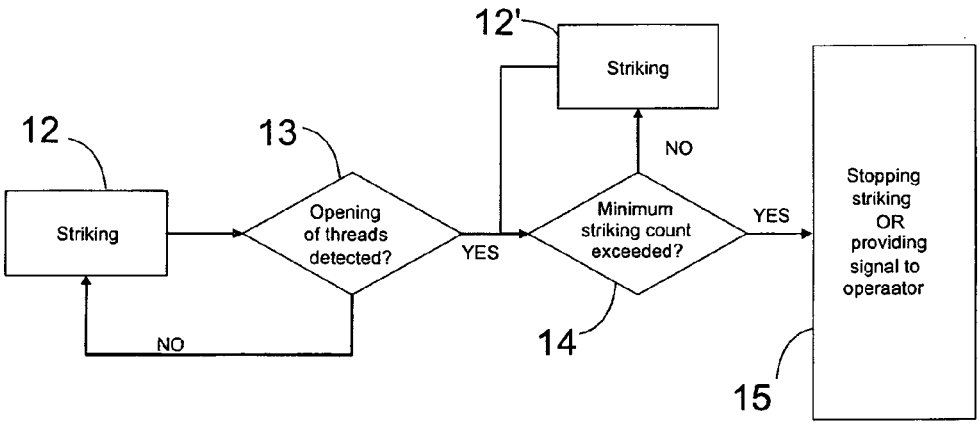
FIG. 2 shows a block diagram of an embodiment of the invention.

FIG. 2 shows a block diagram of an embodiment of the invention. In it, in the first step 12, striking is done while measuring with the measuring means vibration originating from the drilling equipment. In the second step 13, the signal obtained by measuring the vibration signal in accordance with a predefined principle, typically an analysis model, and the result thus obtained can be compared with a predefined model representing open threaded joints or their opening. As long as the analysis or comparison of models indicates that the threads are not open, striking is continued in accordance with step 12' until the opening of the thread is detected. After this, the routine continues to the next step, 14, where it checks whether the minimum striking count has been exceeded. If the minimum limit value has not been exceeded, the routine returns to striking 12' and checks at suitable intervals whether the minimum striking count has been exceeded. The striking can either be stopped between steps or it may be continued non-stop until the decision is made to stop it entirely. When in step 14 it is detected that the minimum striking count has been exceeded, striking is stopped either automatically in ending step 15 or a signal, such as light, audio signal, or message on the display of the control equipment to stop striking, is given to the operator. Alternatively, stopping may be indicated to the operator by a counter-force or vibration supplied to the striking actuator, such as level or push button, which makes it difficult to continue striking. In all cases, the operator is a driller, maintenance man or any other person who uses the rock drilling rig during its operation.

Figure 3:
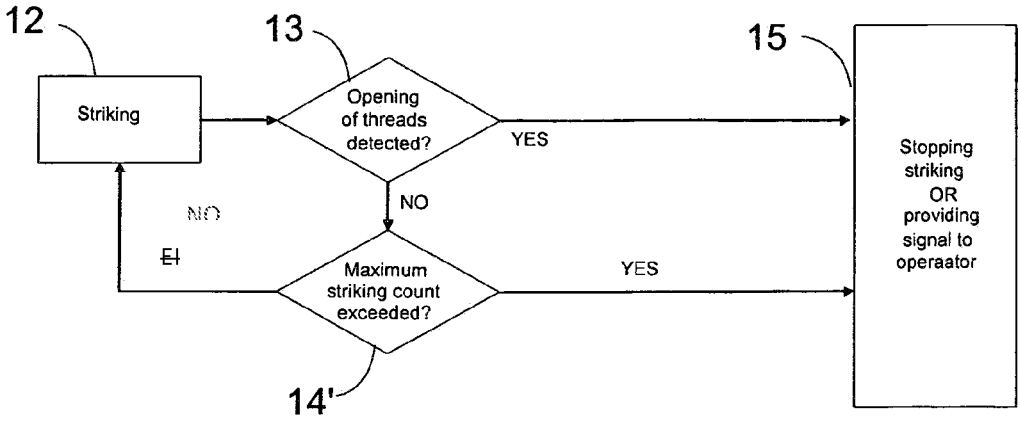
FIG. 3 shows another embodiment of the invention as a block diagram.

FIG. 3 shows another embodiment of the invention. It differs from the embodiment of FIG. 2 in that instead of a minimum striking count, a maximum striking count is defined. In this embodiment, in step 13 after striking 12, the routine checks whether opening of the threads has been detected. If no opening is detected, the routine checks whether the maximum striking limit value has been exceeded in step 14'. If the maximum striking limit value has not been exceeded, the routine returns to striking and continues it until either opening or the exceeding of the maximum striking count is indicated. In this embodiment, too, the striking can either be stopped between steps or it may be continued non-stop until the decision is made to stop it entirely. If the opening of the thread is detected in step 12, the routine moves on to the last step 15, in which striking is stopped automatically or a signal is given to the operator as described in FIG. 1. Alternatively, if the opening of the thread is not detected, but the maximum striking count has been exceeded, the routine again moves to step 15 and stops the striking or gives the operator a signal to stop the striking.

Figure 4:
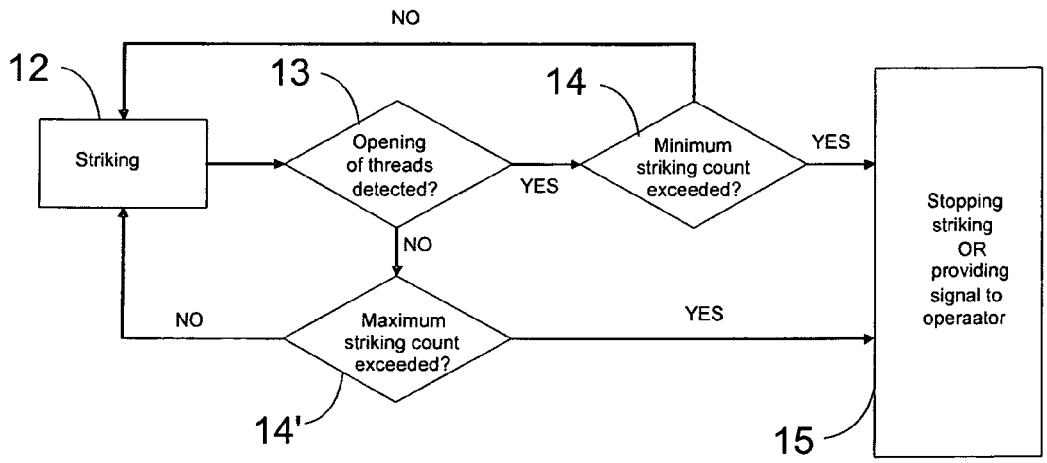
FIG. 4 shows yet another embodiment of the invention as a diagram.

FIG. 4 shows yet another embodiment as a diagram. This uses both the minimum and maximum striking count values as limit values. As for the opening of the thread and the minimum striking count, the operation is approximately the same as in FIG. 1, that is, in step 13, the routine checks whether the threads are open and if yes, it checks, whether the minimum striking count has been exceeded in step 14. If the minimum has not been exceeded, the routine returns to striking, after which it again checks whether the threads are open. If the minimum striking count value has been exceeded, striking is stopped automatically or the operator is given a signal as stated in FIG. 1.

If the opening of the threads is not detected, the routine checks in step 14' whether the maximum striking count value has been exceeded. If it has not been exceeded, the routine returns to striking, after which it again checks whether the threads are open. If the maximum striking count value has been exceeded, the routine moves to the ending step 15, in which striking is stopped automatically or the operator is given a signal to stop the striking. In this embodiment, too, the striking can either be stopped between steps or it may be continued non-stop until the decision is made to stop it entirely.

In the above specification and drawings, the invention is described by way of example only. The functions may be performed automatically by the control device and its devices and means or in such a manner that the control equipment gives the operator a signal in a suitable way. The combination of different embodiments in the manner shown in FIGS. 3 to 5 can also be done in other ways. The striking count may be defined as the number of impacts, amount of impact energy directed to the drill rod, striking time, or in some other manner that represents the volume of striking. Similarly, vibration can be measured with suitable measuring devices as an audio signal, ultrasound signal, acceleration, optically, as a stress wave, or in some other measuring ways known per se. A stress wave may be measured either from the drilling equipment, rock drilling rig body, or some other suitable location in the rock drilling rig. Optical measurement may, in turn, be made using a laser measuring device, or some other optical measuring device suitable for the purpose.

Various measuring devices or other means belonging to the control device may be separate devices connected to the control device or installed inside it, or they may be partially or entirely implemented by a computer program made to run the control device.

The minimum and maximum striking count values may be rock drilling rig-specific or even individual for each rock drilling rig. They may also be altered as necessary for each situation. For instance, when it is noted in certain drilling conditions that an earlier set shorter striking time is enough to open the threads, the maximum striking count is decreased. Similarly, if an earlier defined longer striking time is necessary, because the threads have become even tighter than before in the drilling conditions, the minimum striking count is increased. This alteration of values may be done fully automatically controlled by the control unit, or the control unit may automatically propose an alteration of the limit values on the basis of the already performed striking, and the operator either accepts or rejects the proposal. Another alternative is that the operator does these changes after having noticed in the situation that the striking diverges in one direction or another.

Further, the alteration may be done on the basis of the difference between the detection of the opening of the threads from the analysis/comparison of vibrations and the additional condition(s). This may be done for instance after striking by comparing the detection result of the system that measures vibration and the realization of the limiting conditions. If the values of the limiting conditions are too broad, too strict, or differ from the detection result, or are in some other way unsuitable, it is possible to adjust the values to be more suitable on the basis of the detection, or show to the operator on the display of the control equipment, for instance, a recommendation on new settings for approval or modification.

As an additional condition to the opening of the threaded joints, it is also possible to use a change in the rotating torque when rotating the drilling equipment during striking in the opening direction of the threaded joints, whereby the opening of one threaded joint decreases the rotating torque of the rest of the drill rods connected to the rock drilling rig, that is, the rest of the drilling equipment.

After striking, the drilling equipment can be rotated in the closing direction for the sake of safety so that the open threaded joints tighten slightly and parts of the drilling equipment cannot detach from each other. This may also be done automatically so that the control device is arranged to slightly tighten the drilling equipment after the striking has stopped.

The invention claimed is:

1. A method for opening threaded joints of drilling equipment by striking the drilling equipment with a percussion device of a rock drilling rig, the method comprising the steps of:

measuring vibration originating from a drill rod during striking;

analysing the measured vibration according to a predefined principle for the purpose of determining whether the threaded joints have opened; and defining for the striking at least one additional condition, on the basis of which the decision to stop striking is made by using as one additional condition a striking count limit value.

2. A method as claimed in claim 1, further comprising the step of using as the striking count limit value a minimum striking count limit value that should be exceeded during striking before stopping striking.

3. A method as claimed in claim 1, further comprising the step of using as the striking count limit value a maximum striking count limit value, after which striking should be stopped.

4. A method as claimed claim 2, wherein the step of defining comprises defining the striking count as a number of impacts.

5. A method as claimed in claim 2, wherein the step of defining comprises defining the striking count on the basis of impact energy directed to the drill rod.

6. A method as claimed in claim 2, wherein the step of defining comprises defining the striking count as a time used for striking.

7. A method as claimed in claim 1, further comprising the step of using as one additional condition a change in rotating torque when rotating the drilling equipment in the opening direction of the threads.

8. A method as claimed in claim 2, further comprising the step of comparing the measured signal with a predefined model representing the opening of the threads, and if the comparison shows that the threads have opened, checking whether the minimum striking count has been exceeded, and if it has not, continuing striking, and correspondingly, if the minimum striking count has been exceeded, stopping striking.

9. A method as claimed in claim 8, wherein the striking is continued non-stop until the minimum striking count has been reached.

10. A method as claimed in claim 2, further comprising the step of comparing the striking count to a set maximum striking count value, if the signal comparison indicates that the threaded joints have not opened, and continuing striking, if the maximum striking count value has not been exceeded, and correspondingly, stopping striking, if the maximum striking count value has been exceeded.

11. A method as claimed in claim 10, wherein the striking is continued until the maximum striking count value has been exceeded.

12. A method as claimed in claim 2, wherein striking is automatically stopped under the control of a control unit of the rock drilling rig.

13. A method as claimed in claim 1, further comprising the step of adjusting the limit values of the striking counts on the basis of actual striking counts.

14. A method as claimed in claim 13, wherein the striking count limit values are adjusted on the basis of a vibration signal measured from the drill rods.

15. A method as claimed in claim 14, wherein the striking count limit values are adjusted by comparing the measured signal with at least one stored predefined vibration model.

16. A method as claimed in claim 2, further comprising the step of using as the striking count limit value a maximum striking count limit value after which striking should be stopped.

17. An apparatus for opening threaded joints of drilling equipment by striking the drilling equipment with a percussion device of a rock drilling rig, the apparatus comprising:

a control device for controlling the rock drilling rig, the control device having a measuring device for measuring vibration originating from a drill rod during striking;

analysing means in communication with the control device for analysing the measured vibration according to a predefined principle for the purpose of determining whether the threaded joints have opened; and measuring means in communication with the control device for measuring a parameter that defines at least one additional condition including whether the threads are opened or opening, on the basis of which the decision to stop striking is made, wherein the measuring means for measuring at least one additional condition are arranged to measure a striking count value.

18. An apparatus as claimed in claim 17, wherein the measuring means for measuring the at least one additional condition are arranged to measure a minimum striking count limit value that should be exceeded during striking before stopping striking.

19. An apparatus as claimed in claim 17, wherein the measuring means for measuring the at least one additional condition are arranged to measure a maximum striking count that should be exceeded during striking before stopping striking.

20. An apparatus as claimed in claim 19, wherein the control device is arranged to control the rock drilling rig to continue striking until the maximum striking count value has been exceeded.

21. An apparatus as claimed in claim 18, wherein the measuring means for measuring the at least one additional condition are arranged to measure the number of impacts.

22. An apparatus as claimed in claim 18, wherein the measuring means for measuring the at least one additional condition are arranged to measure the amount of impact energy directed to the drill rod.

23. An apparatus as claimed in claim 18, wherein the measuring means for measuring the at least one additional condition are arranged to measure the striking count as striking time used in striking.

24. An apparatus as claimed in claim 17, wherein the measuring means for measuring the at least one additional condition are arranged to measure a change in rotating torque when the drilling equipment is rotated in the opening direction of the threads.

25. An apparatus as claimed in claim 17, wherein the analysing means for analysing the measured vibration are arranged to compare the measured signal with a predefined model representing the opening of the threads, and if the comparison shows that the threads have opened, the control device is arranged to check whether the minimum striking count has been exceeded, and if it has not, the control device is arranged to control the rock drilling rig to continue striking, and correspondingly, if the minimum striking count has been exceeded, to stop striking.

26. An apparatus as claimed in claim 25, wherein the control device is arranged to control the rock drilling rig to continue striking non-stop until the minimum striking count has been reached.

27. An apparatus as claimed in claim 17, wherein if the signal comparison indicates that the threaded joints have not opened, the control device is arranged to compare the striking count with the set maximum striking count value, and, if the maximum striking count value has not been exceeded, the control device is arranged to continue striking, and correspondingly, if the maximum striking count value has been exceeded, to stop striking.

28. An apparatus as claimed in claim 27, wherein the control device is arranged to control the rock drilling rig to continue striking non-stop until the maximum striking count has been reached.

29. An apparatus as claimed in claim 17, wherein the stopping of striking is performed automatically under the control of the control unit of the rock drilling rig.

30. An apparatus as claimed in claim 17, wherein the control device is arranged to adjust the limit values of the striking counts on the basis of actual striking counts.

31. An apparatus as claimed in claim 30, wherein the control device is arranged to adjust the striking count limit values on the basis of a vibration signal measured from the drill rods.

32. An apparatus as claimed in claim 31, wherein the control device is arranged to adjust the striking count limit values by comparing the measured signal with at least one stored predefined vibration model.

* * * * *